US007314325B2

(12) United States Patent
Chang et al.

(10) Patent No.: US 7,314,325 B2
(45) Date of Patent: Jan. 1, 2008

(54) PEN-AND-ELECTRONIC DEVICE ASSEMBLY

(75) Inventors: Han-Chao Chang, Tainan (TW); Jen-Lin Chen, 11648 Birch Spring Ct., Cupertino, CA (US) 95014

(73) Assignee: Jen-Lin Chen, Cupertino, CA (US)

( * ) Notice: Subject to any disclaimer, the term of this patent is extended or adjusted under 35 U.S.C. 154(b) by 228 days.

(21) Appl. No.: 11/313,060

(22) Filed: Dec. 19, 2005

(65) Prior Publication Data

US 2007/0139914 A1 Jun. 21, 2007

(51) Int. Cl.
*B43K 29/00* (2006.01)
*B43K 5/16* (2006.01)

(52) U.S. Cl. ..... 401/195; 401/52; 362/118

(58) Field of Classification Search ..... 401/52, 401/195; 362/118, 253
See application file for complete search history.

(56) References Cited

U.S. PATENT DOCUMENTS 6,158,871 A 12/2000 Geddes et al.
6,164,856 A * 12/2000 Lo ..... 401/195
6,585,388 B2 * 7/2003 Kim ..... 401/195
6,604,880 B1 * 8/2003 Huang et al. ..... 401/195
6,837,639 B2 * 1/2005 Hui ..... 401/195

FOREIGN PATENT DOCUMENTS

DE 202 19 971 4/2003

* cited by examiner

*Primary Examiner*—Tuan Nguyen

(57) ABSTRACT

A pen-and-electronic device assembly comprises: a barrel; a writing member; and an electronic device. The electronic device includes: a housing having a battery-mounting part including top and bottom walls and a peripheral wall cooperating with the top and bottom walls to define an enclosed battery compartment, the peripheral wall including a first portion fixed to the top and bottom walls and defining an access opening, and a second portion connected detachably to the first portion for covering the access opening; and a circuit unit in the housing. The second portion is fastened to the bottom wall so as to prevent undesired access to the battery compartment.

8 Claims, 8 Drawing Sheets

PEN-AND-ELECTRONIC DEVICE ASSEMBLY

BACKGROUND OF THE INVENTION

1. Field of the Invention

This invention relates to a pen-and-electronic device assembly, more particularly to a pen-and-electronic device assembly with an enclosed battery compartment.

2. Description of the Related Art

German Utility Model No. 202.19.971.1 discloses a pen including a barrel, a writing member extending into the barrel, and an electronic device connected to the barrel. The electronic device includes a battery housing received in the barrel, a circuit board, a speaker, and batteries enclosed in the battery housing. Since the batteries are sealed in the battery housing in order to prevent a child from gaining access to the batteries, replacement of the batteries cannot be performed, and recycling of the batteries requires cutting of the battery housing, which can discourage battery recycling, and which, in turn, results in environmental concern.

U.S. Pat. No. 6,158,871 discloses a pen with an illuminating device. The pen includes a tubular holder, a hollow protective member mounted on an upper end of the tubular holder and having two halves fixedly joined together, a battery mounting received in the hollow protective member and adapted to receive batteries therein, a light-mounting seat mounted on the battery mounting, a light bulb mounted on the light-mounting seat and coupled to the batteries, and a reservoir tube fitted inside the tubular holder for writing purpose.

The aforesaid pen is disadvantageous in that replacement or recycling of the batteries requires detachment of the halves of the hollow protective member as well as removal of the light bulb and the light-mounting seat from the battery mounting, which are relatively laborious and time-consuming.

SUMMARY OF THE INVENTION

Therefore, the object of the present invention is to provide a pen-and-electronic device assembly that is capable of overcoming the aforesaid drawbacks of the prior art.

According the present invention, there is provided a pen-and-electronic device assembly that comprises: a barrel; a writing member mounted in the barrel and extending through the barrel for writing purpose; and an electronic device connected detachably to the barrel. The electronic device includes: a housing having a battery-mounting part that extends into the barrel, and that includes top and bottom walls and a peripheral wall interconnecting the top and bottom walls and cooperating with the top and bottom walls to define an enclosed battery compartment which is adapted to receive a battery unit therein, the top and bottom walls being respectively provided with upper and lower contacts; and a circuit unit mounted in the housing and adapted to be coupled to the battery unit through the upper and lower contacts. The peripheral wall of the battery-mounting part includes a first portion extending between and fixed to peripheral edges of the top and bottom walls and having an open end that defines an access opening, and a second portion connected detachably to the open end of the first portion for covering the access opening and fastened to the bottom wall of the battery-mounting part.

BRIEF DESCRIPTION OF THE DRAWINGS

In drawings which illustrate embodiments of the invention,

FIG. 6 is a sectional assembled view illustrating another state where the electronic device of the first preferred embodiment is turned on;

DETAILED DESCRIPTION OF THE PREFERRED EMBODIMENTS

Figure 1:
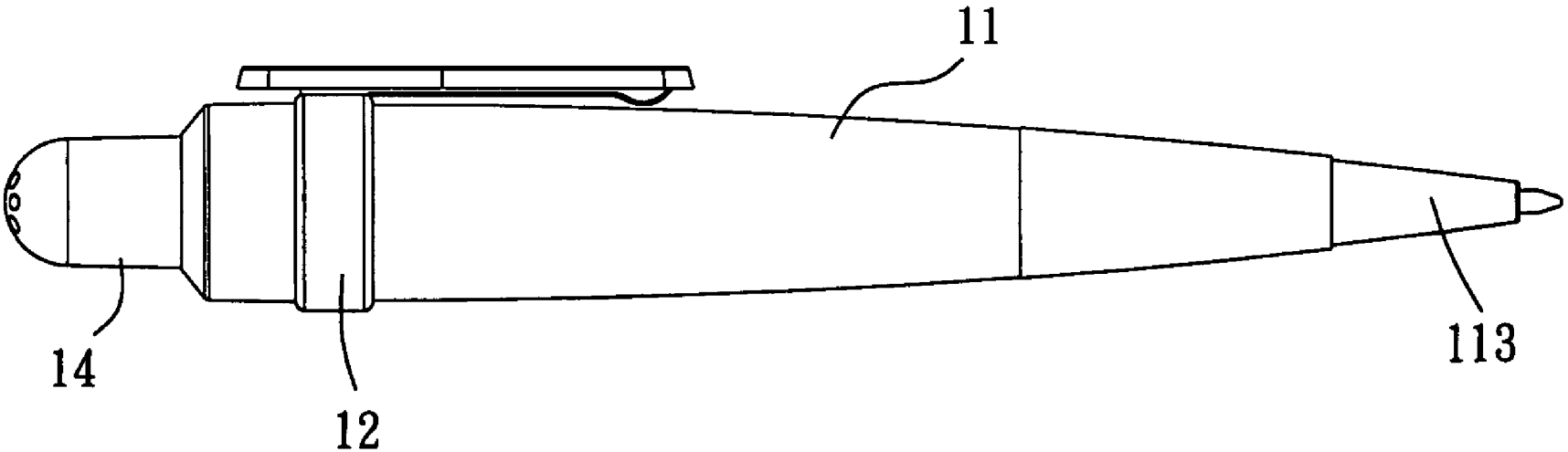
FIG. 1 is a schematic view of the first preferred embodiment of a pen-and-electronic device assembly according to this invention.
Figure 2:
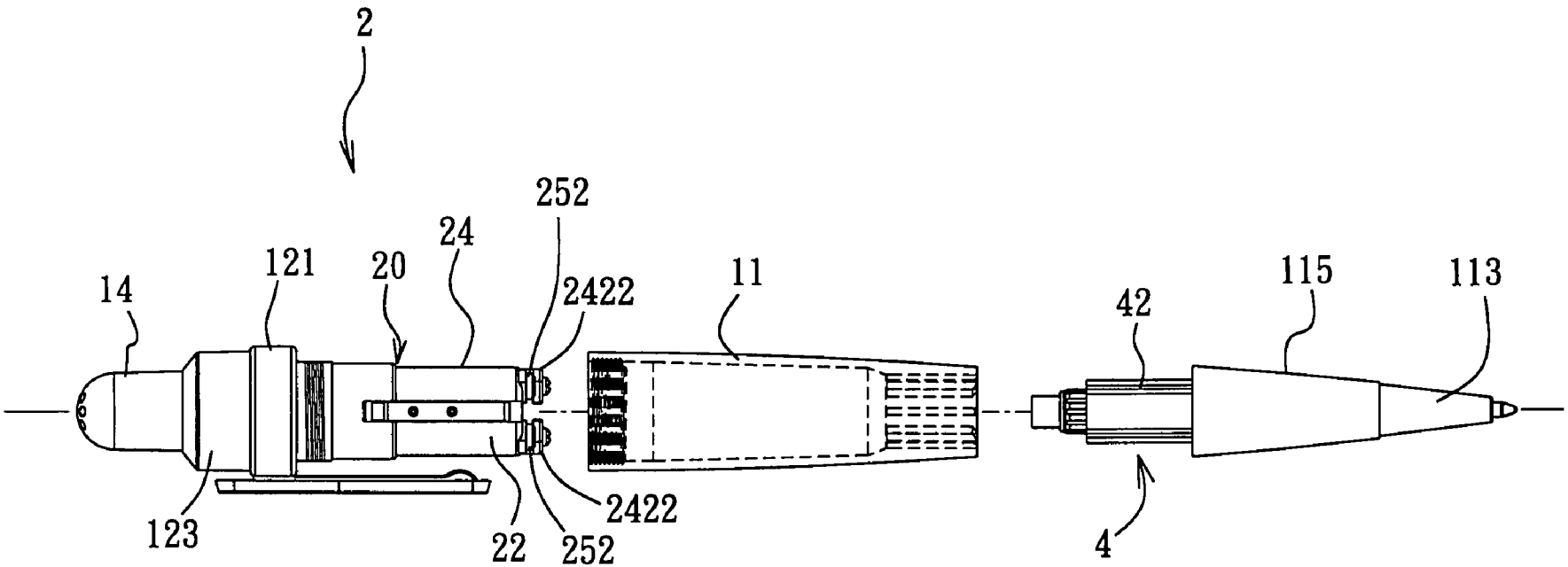
FIG. 2 is a schematic exploded view of the first preferred embodiment.
Figure 3:
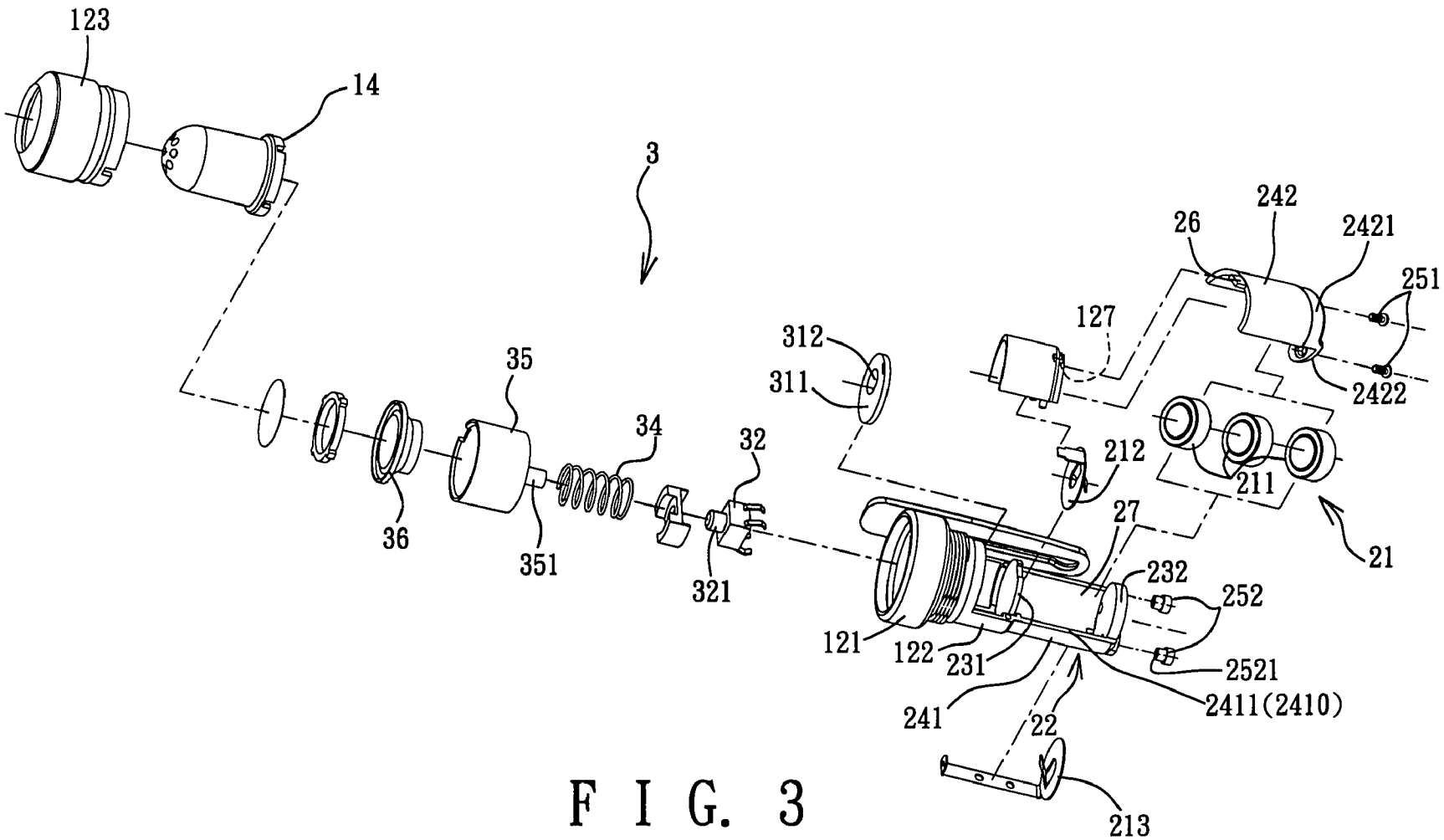
FIG. 3 is an exploded perspective view of an upper part of the pen-and-electronic device assembly of the first preferred embodiment.
Figure 4:
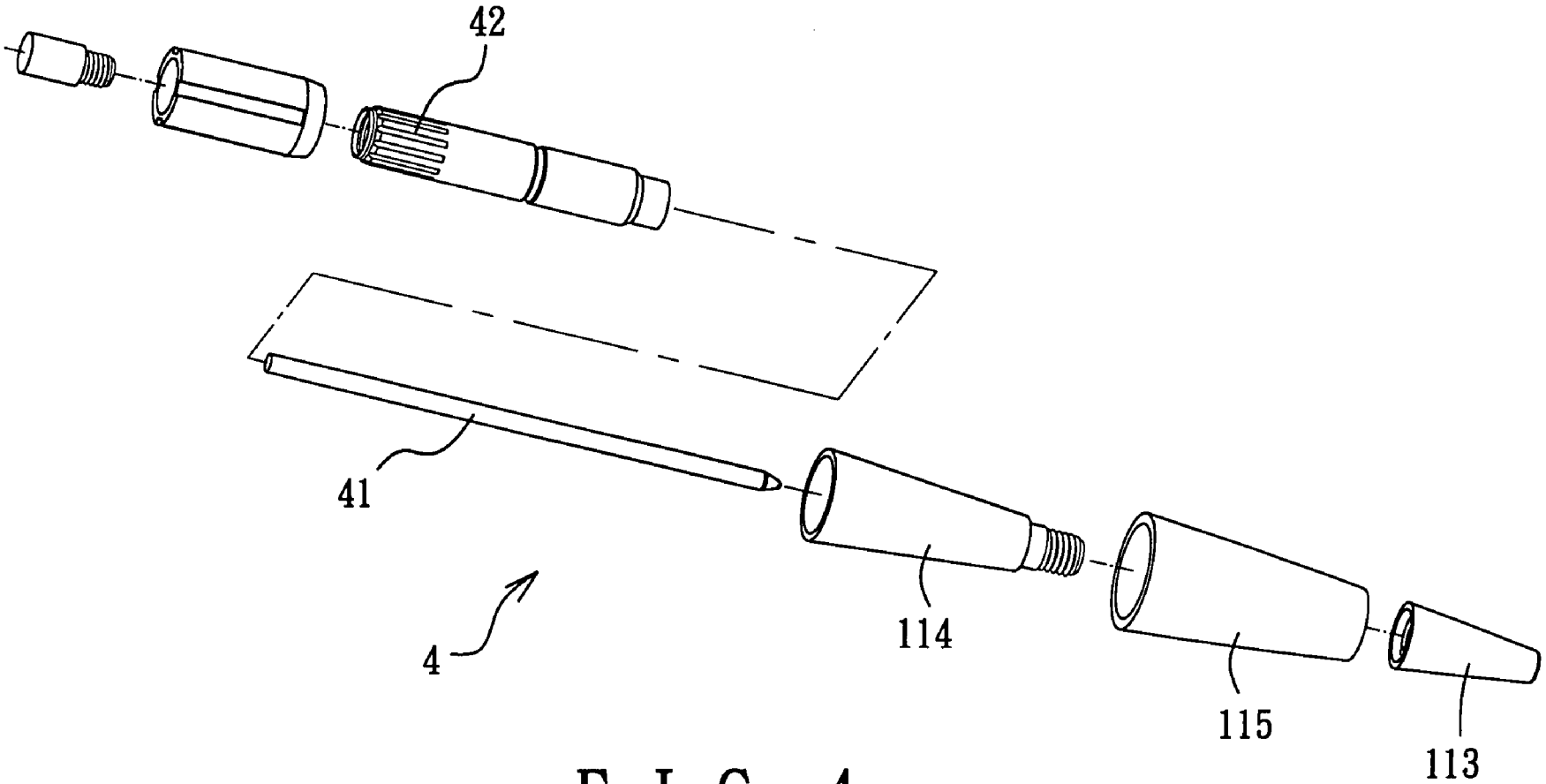
FIG. 4 is an exploded perspective view of a lower part of the pen-and-electronic device assembly of the first preferred embodiment.
Figure 5:
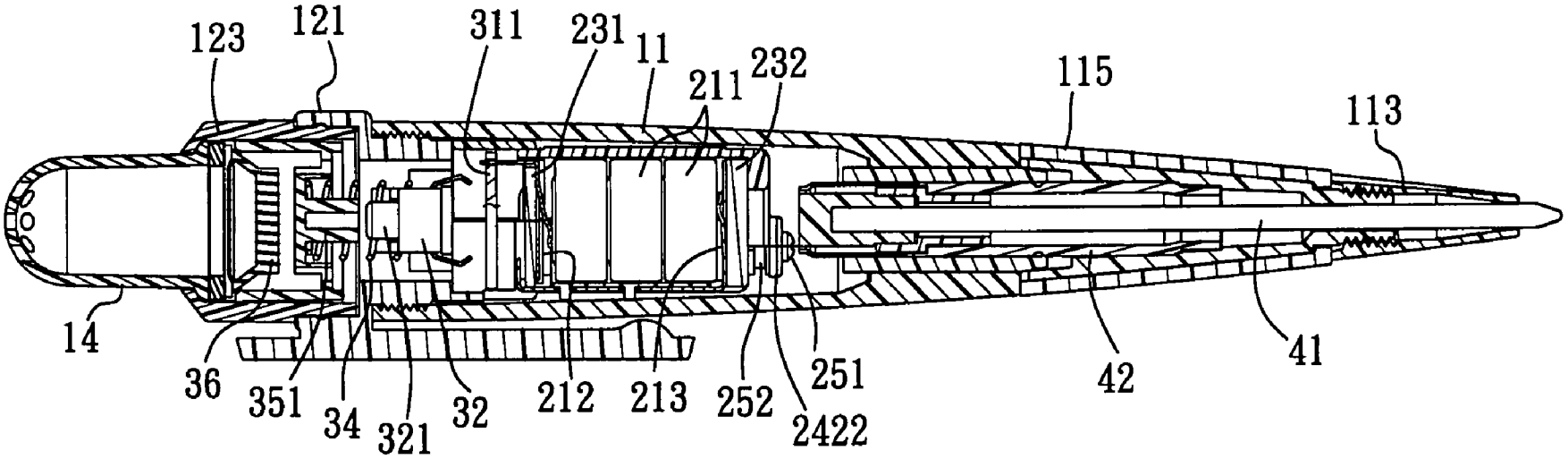
FIG. 5 is a sectional assembled view illustrating a state where an electronic device of the first preferred embodiment is turned off.

Before the present invention is described in greater detail with reference to the accompanying preferred embodiments, it should be noted herein that like elements are denoted by the same reference numerals throughout the disclosure.

FIGS. 1 to 5 illustrate the first preferred embodiment of a pen-and-electronic device assembly according to the present invention.

The pen-and-electronic device assembly includes: a barrel 11 having a bottom end 113; a writing member 4 mounted in the barrel 11 and extending through the bottom end 113 of the barrel 11 for writing purpose; and an electronic device 2 connected detachably to the barrel 11. The electronic device 2 includes: a tubular housing 20 having a battery-mounting part 22 that extends into the barrel 11, and that includes top and bottom walls 231, 232 and a peripheral wall 24 interconnecting the top and bottom walls 231, 232 and cooperating with the top and bottom walls 231, 232 to define an enclosed battery compartment 27 thereamong, the top and bottom walls 231, 232 being respectively provided with upper and lower contacts 212, 213, the peripheral wall 24 including a first portion 241 extending between and fixed to peripheral edges of the top and bottom walls 231, 232 and having an open end 2411 that defines an access opening 2410, and a second portion 242 connected detachably to the open end 2411 of the first portion 241 for covering the access opening 2410 and fastened to the bottom wall 232, thereby preventing access to the battery compartment 27; and a circuit unit 3 mounted in the housing 20. A battery unit 21, which includes three button cells 211, is mounted in the battery compartment 27, is coupled to the circuit unit 3 through the upper and lower contacts 212, 213, and is removable from the battery compartment 27 through the access opening 2410 of the first portion 241 of the peripheral wall 24 of the battery-mounting part 22 upon detachment of the second portion 242 from the first portion 241 of the peripheral wall 24 of the battery-mounting part 22.

In this embodiment, the second portion 242 of the peripheral wall 24 of the battery-mounting part 22 has a bottom end 2421 that is formed with two ears 2422 (see FIGS. 2 and 3) extending transversely therefrom and fastened to the bottom wall 232 of the battery-mounting part 22 through fasteners 251, thereby preventing removal of the second portion 242 from the first portion 241 of the peripheral wall 24 of the battery-mounting part 22, which, in turn, prevents undesired access to the battery unit 21 in the battery compartment 27.

Preferably, the bottom wall 232 of the battery-mounting part 22 is formed with two studs 252, each of which protrudes downwardly therefrom and each of which has an axially extending inner thread 2521. The ears 2422 are disposed below and are aligned with the studs 252. The fasteners 251 are in the form of screws that extend respectively through the ears 2422 and into the studs 252 to engage threadedly and respectively the inner threads 2521 of the studs 252, thereby fastening the second portion 242 to the first portion 241 of the peripheral wall 24 of the battery-mounting part 22. Note that the studs 252 can be either integrally formed with the bottom wall 232 or formed as separate pieces.

The housing 20 of the electronic device 2 further has a circuit board-mounting part 122 that is enlarged in cross-section from the top wall 231 of the battery-mounting part 22 and that is formed with a retaining groove 127. The circuit unit 3 includes a circuit board 311 that is mounted in the circuit board-mounting part 122 and that is coupled to the battery unit 21 through the upper and lower contacts 212, 213. The second portion 242 of the peripheral wall 24 of the battery-mounting part 22 further has a top end that is formed with a retaining tongue 26 which engages the retaining groove 127 when the second portion 242 covers the open end 2411 of the first portion 241 of the peripheral wall 24 of the battery-mounting part 22. A chip 312 is mounted on the circuit board 311, and serves to store acoustic data.

The housing 20 of the electronic device 2 further has a switch-mounting seat 121 that is enlarged in cross-section from the circuit board-mounting part 122, and a cap 123 that extends into and that is connected to the switch-mounting seat 121. A switch 32 is mounted in the switch-mounting seat 121, has a pressable button 321, and is coupled to the circuit board 311 for enabling and disabling the circuit unit 3.

The barrel 11 further has a rotatable lower section 114 connected to the bottom end 113 of the barrel 11. An anti-slip sleeve 115 is sleeved on the lower section 114 for facilitating operation of the lower section 114. The writing member 4 includes a reservoir tube 41 with a tip, and a writing tip-controlling member 42 that extends into the lower section 114 and that is connected to the barrel 11 and the reservoir tube 41 in such a manner that rotation of the lower section 114 of the barrel 11 results in telescopic movement of the reservoir tube 41 so as to move the tip of the reservoir tube 41 out of and into the barrel 11.

Figure 6:
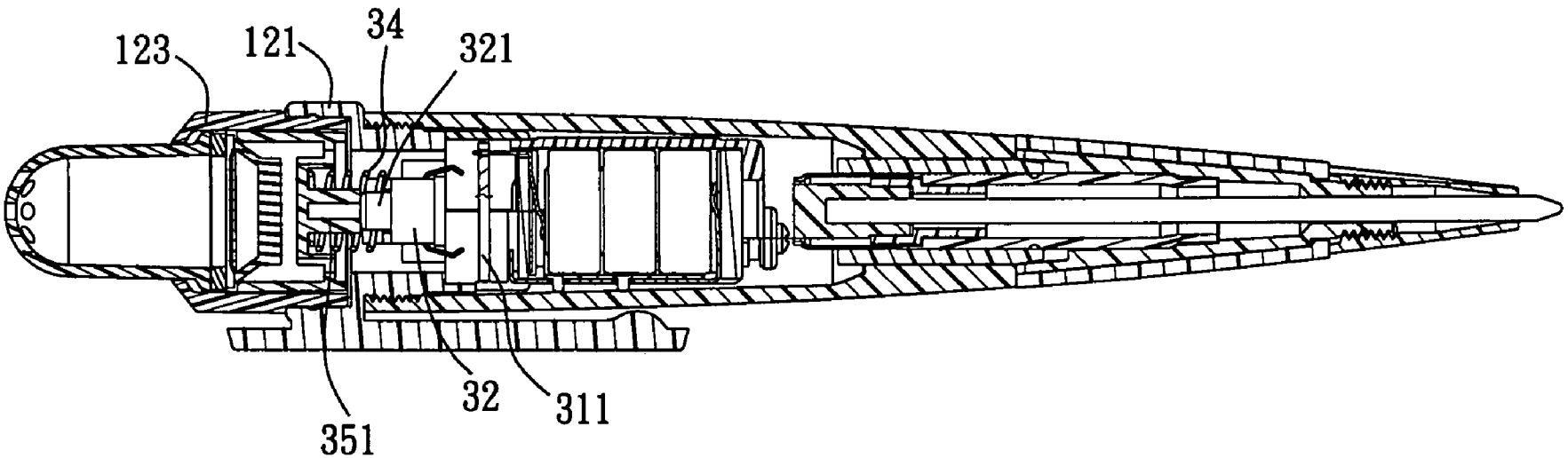

The circuit unit 3 further includes a component-mounting seat 35 disposed in the cap 123 and formed with a protrusion 351 extending toward the pressable button 321 of the switch 32, an electronic component 36, such as a speaker, a microphone, an LED light bulb and a radio frequency receiver (such as a Bluethooth RF IC card), mounted in the component-mounting seat 35 and coupled to the circuit board 311, and an urging member 34 disposed between and abutting against the switch 32 and the component-mounting seat 35. A push button 14 extends through the cap 123 and into the component-mounting seat 35, and is operable to move the component-mounting seat 35 downwardly so as to push the pressable button 321 through the protrusion 351 (see FIG. 6), thereby enabling or disabling the circuit unit 3. For instance, when the electronic component 36 is a speaker and when the push button 14 is pressed, the circuit unit 3 is enabled and generates a sound through the chip 312 and the speaker 36, and is disabled immediately after the sound generating activity is finished. The push button 14 and the pressable button 321 are restored to their normal positions (see FIG. 5) by the urging action of the urging member 34 when the push button 14 is released from the pressing action.

Figure 7:
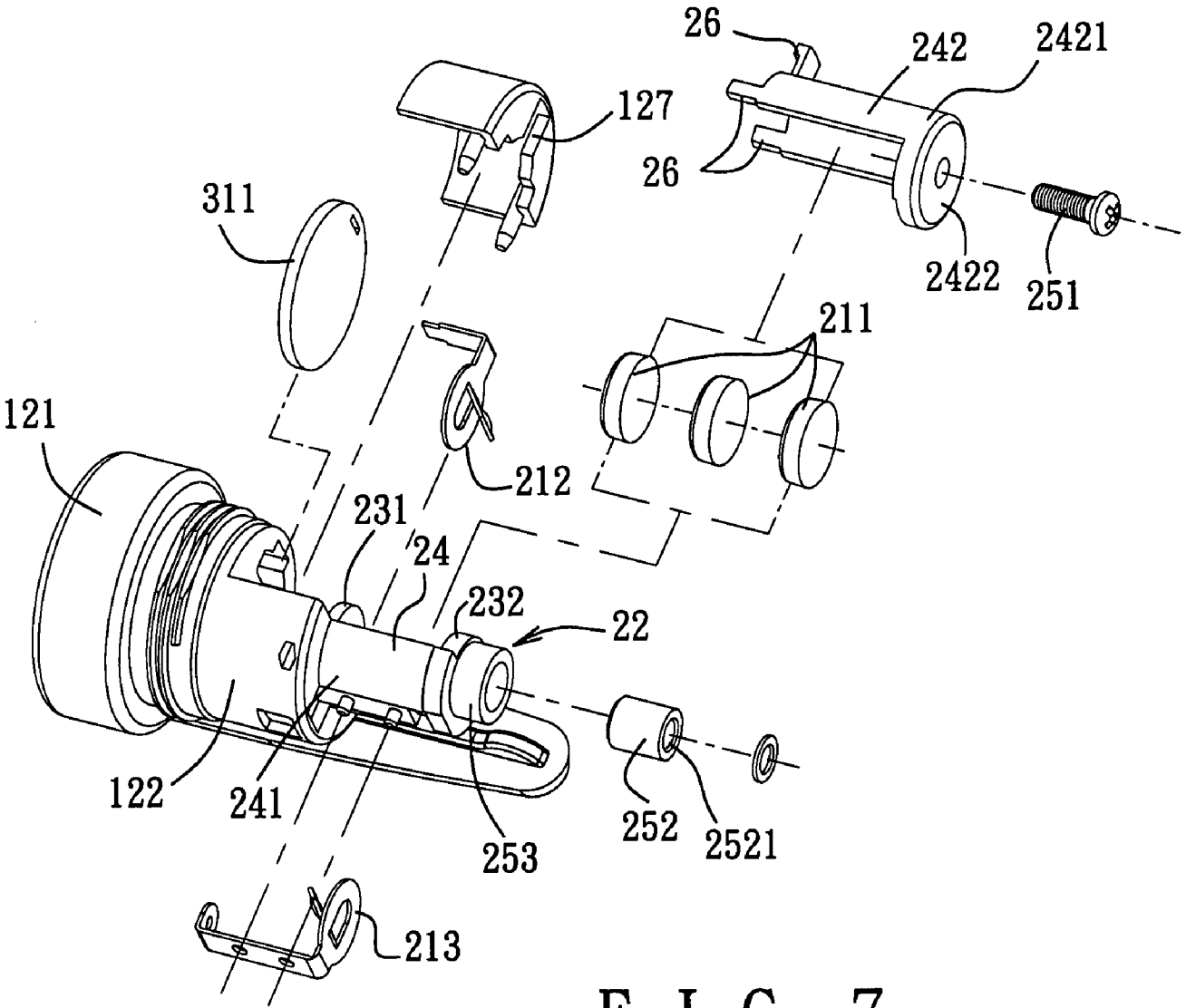
FIG. 7 is an exploded perspective view of the electronic device of the second preferred embodiment of the pen-and-electronic device assembly according to the present invention.

FIG. 7 illustrates the second preferred embodiment of the pen-and-electronic device assembly according to this invention. The pen-and-electronic device assembly of this embodiment differs from the previous embodiment in that only one ear 2422 is formed on the bottom end 2421 of the second portion 242 of the peripheral wall 24 of the battery-mounting part 22 and that a stud-mounting sleeve 253 is formed on and protrudes downwardly from the bottom wall of the battery-mounting part 22. The stud 252 is fitted into the sleeve 253.

Figure 8:
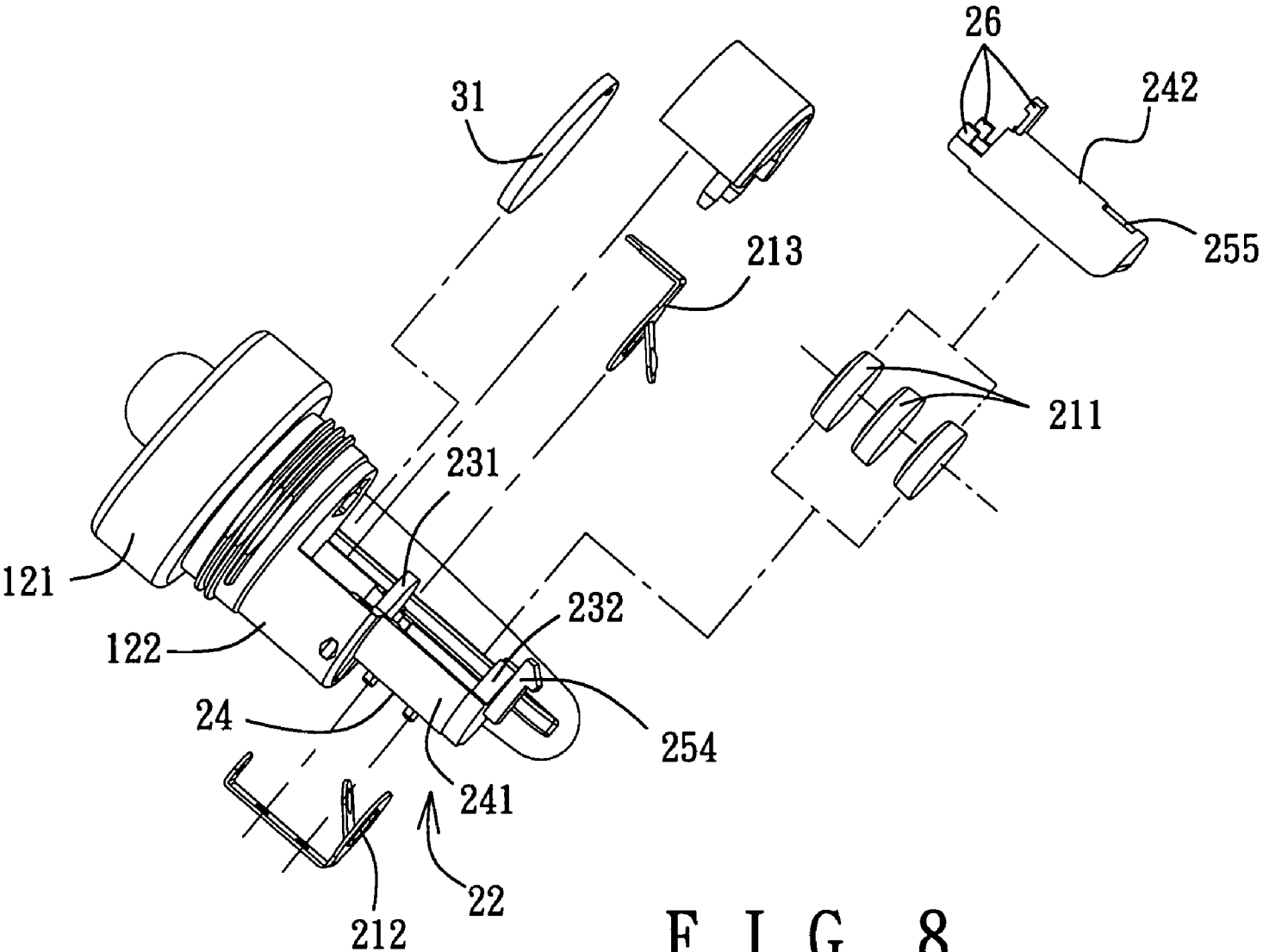
FIG. 8 is an exploded perspective view of the electronic device of the third preferred embodiment of the pen-and-electronic device assembly according to the present invention.

FIG. 8 illustrates the third preferred embodiment of the pen-and-electronic device assembly according to this invention. The pen-and-electronic device assembly differs from the first embodiment in that the second portion 242 of the peripheral wall 24 of the battery-mounting part 22 is formed with a retaining hole 255, and that the bottom wall 232 of the battery-mounting part 22 is formed with a latch 254 with a hook end. The latch 254 extends radially from the bottom wall 232 through the retaining hole 255, and the hook end of the latch 254 is in snap engagement with a periphery of the retaining hole 255, thereby fastening the second portion 242 to the first portion 241 of the peripheral wall 24 of the battery-mounting part 22.

By dividing the peripheral wall 24 of the battery-mounting part 22 into the first and second portions 241, 242, which are fastened to each other, and by fixing the first portion 241 to the top and bottom walls 231, 232 of the battery-mounting part 22, access to the battery unit 21 in the battery compartment 27 by a child can be avoided, and removal of the battery unit 21 from the battery compartment 27 can be easily performed by simply loosening the fastener(s) 251. As such, the aforesaid drawbacks associated with the prior art can be eliminated.

With the invention thus explained, it is apparent that various modifications and variations can be made without departing from the spirit of the present invention.

What is claimed is:

1. A pen-and-electronic device assembly comprising:

a barrel;

a writing member mounted in said barrel and extending through said barrel for writing purpose; and an electronic device connected detachably to said barrel and including a housing having a battery-mounting part that extends into said barrel, and that includes top and bottom walls and a peripheral wall interconnecting said top and bottom walls and cooperating with said top and bottom walls to define an enclosed battery compartment which is adapted to receive a battery unit therein, said top and bottom walls being respectively provided with upper and lower contacts, and a circuit unit mounted in said housing and adapted to be coupled to the battery unit through said upper and lower contacts;

wherein said peripheral wall of said battery-mounting part includes a first portion extending between and fixed to peripheral edges of said top and bottom walls and having an open end that defines an access opening, and a second portion connected detachably to said open end of said first portion for covering said access opening and fastened to said bottom wall of said battery-mounting part.

2. The pen-and-electronic device assembly of claim 1, further comprising a fastener, said second portion of said peripheral wall of said battery-mounting part having a bottom end that is formed with an ear extending transversely therefrom and fastened to said bottom wall of said battery-mounting part through said fastener, thereby preventing removal of said second portion from said first portion of said peripheral wall of said battery-mounting part.

3. The pen-and-electronic device assembly of claim 2, wherein said bottom wall of said battery-mounting part is formed with a stud that protrudes downwardly therefrom and that has an axially extending inner thread, said ear being disposed below and being aligned with said stud, said fastener being in the form of a screw that extends through said ear and into said stud to engage threadedly said inner thread, thereby fastening said second portion to said first portion of said peripheral wall of said battery-mounting part.

4. The pen-and-electronic device assembly of claim 3, wherein said housing further has a circuit board-mounting part that is enlarged in cross-section from said top wall of said battery-mounting part and that is formed with a retaining groove, said circuit unit including a circuit board that is mounted in said circuit board-mounting part and that is adapted to be coupled to the battery unit through said upper and lower contacts, said second portion of said peripheral wall of said battery-mounting part further having a top end that is formed with a retaining tongue which engages said retaining groove when said second portion covers said open end of said first portion of said peripheral wall of said battery-mounting part.

5. The pen-and-electronic device assembly of claim 4, wherein said circuit unit further includes a speaker coupled to said circuit board.

6. The pen-and-electronic device assembly of claim 4, wherein said circuit unit further includes a radio frequency receiver that is coupled to said circuit board.

7. The pen-and-electronic device assembly of claim 4, wherein said circuit unit further includes a light emitting member that is coupled to said circuit board.

8. The pen-and-electronic device assembly of claim 4, wherein said circuit unit further includes a microphone that is coupled to said circuit board.

* * * * *